United States Patent [19]

Nitzki

[11] 4,069,788

[45] Jan. 24, 1978

[54] METHOD AND APPARATUS FOR CONDUCTING WATER THROUGH SHIPS

[75] Inventor: Leopold Nitzki, Bremen, Germany

[73] Assignee: Aktien-Gesellschaft "Weser", Bremen, Germany

[21] Appl. No.: 681,033

[22] Filed: Apr. 28, 1976

Related U.S. Application Data

[63] Continuation of Ser. No. 607,956, Aug. 26, 1975, abandoned, which is a continuation of Ser. No. 443,154, Feb. 15, 1974, abandoned.

[30] Foreign Application Priority Data

Feb. 17, 1973 Germany ..... 2307979

[51] Int. Cl.[2] ..... B63H 23/32

[52] U.S. Cl. ..... 115/76; 115/75

[58] Field of Search ..... 115/76, 75; 114/270, 114/183 R; 165/44

[56] References Cited

U.S. PATENT DOCUMENTS 2,990,797 7/1961 Moeller ..... 115/.5 HC

FOREIGN PATENT DOCUMENTS 369,209 3/1920 Germany ..... 115/.5 R

*Primary Examiner*—Trygve M. Blix
*Assistant Examiner*—Stuart M. Goldstein
*Attorney, Agent, or Firm*—Michael J. Striker

[57] ABSTRACT

Marine water is conducted onto a ship from a bilge vortex area, and is discharged from the ship into a dead water area above the ship's propeller. The water is moved from the vortex area to the dead water area with the aid of suction generated by the propeller. On the ship the water is desirably used for cooling purposes in the propeller's power plant, particularly in a condensor of the power plant.

11 Claims, 4 Drawing Figures

FIG. 1
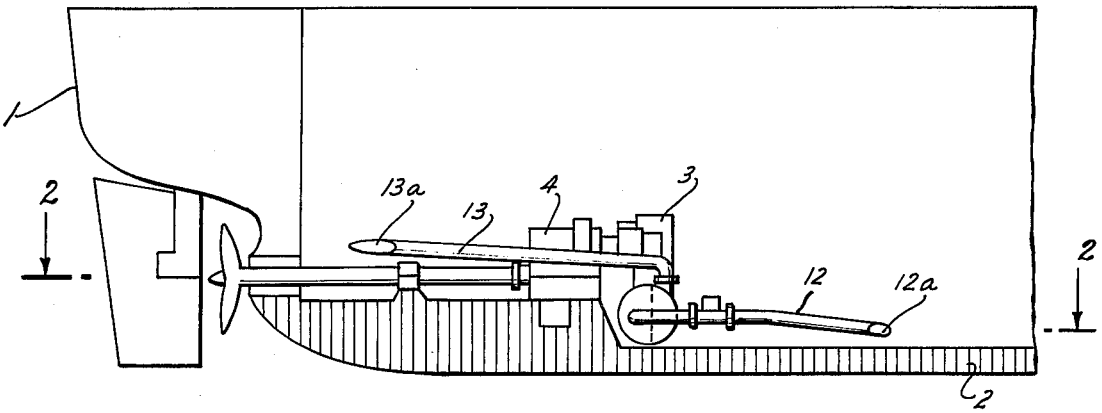
FIG. 2
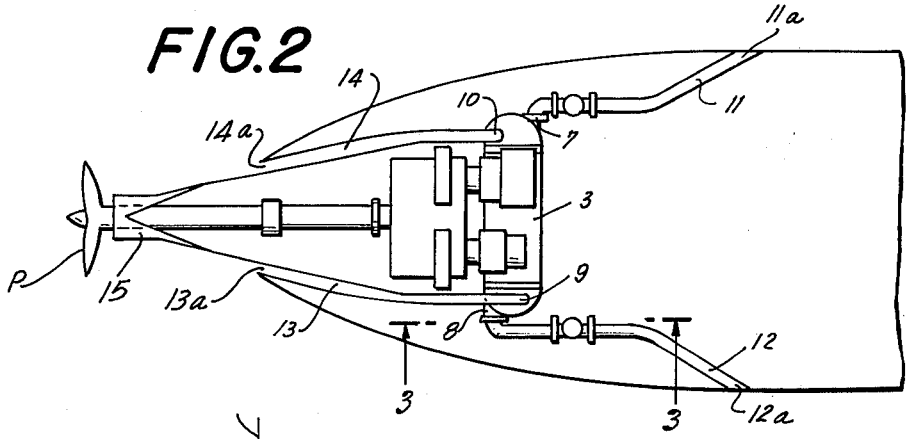
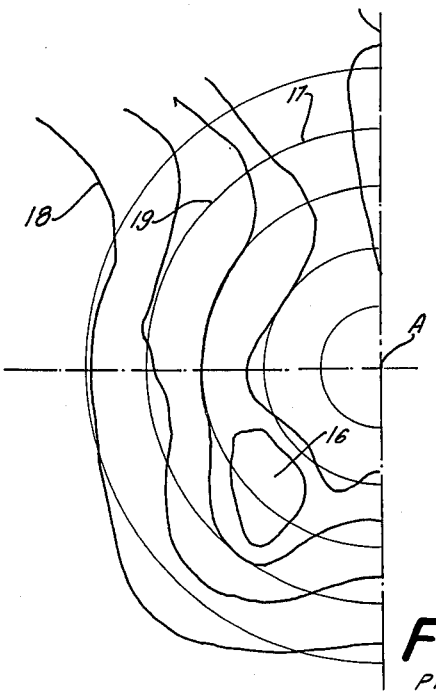
FIG. 4
PRIOR ART
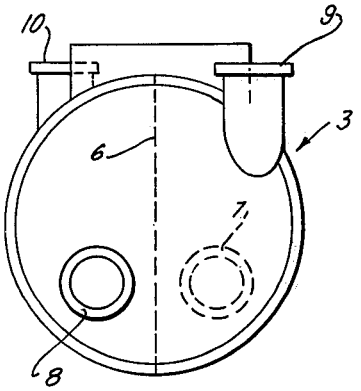
FIG. 3

METHOD AND APPARATUS FOR CONDUCTING WATER THROUGH SHIPS

This is a continuation of application Ser. No. 607,956, filed 8/26/75 which in turn is a continuation of application Ser. No. 443,154, filed 2/15/74, both applications being abandoned.

BACKGROUND OF THE INVENTION

It is known that the lines of equal speed of water relative to a ship, and mainly the isotach field lines of a ship's propeller, are disturbed by two major influences: the generation of bilge vortices on the sides of the ship, and the generation of a dead water area in the wake of the ship. The vortices are generated mainly near the area where the parallel sides of the midship portion begin to curve into the stern of the ship, while the dead water zone is a region defined by the stem of the ship's hull and by the entrance angle of the water lines. Both disturbances, the vortex zone and the dead water zone, lead to losses in efficiency of propulsion, to increased wear and tear of the propeller, and to vibrations of the propeller and ship. The invention serves to minimize these disturbances and resulting disadvantages.

It has been known to conduct water in a generally sternward direction into, through and from a ship, particularly for cooling the condenser of a propeller power plant. The water has been introduced through the hull or bottom of the ship, and it has also been usual to remove such water through the bottom or hull of the ship. The cooling water is usually circulated by pumps, but has also been scooped onto and through the ship without the aid of pumps, in arrangements known to persons skilled in the art. In one such arrangement, cooling water is introduced into the ship at the approximate elevation of one-half the draft of the ship, in the region of maximum pressure in the flow of water relative to the going ship, the cooling water being removed in the approximate region of the bilge, an area of reduced pressure. Such earlier arrangement is effectively useable only in the presence of relatively thin boundary layers of the flow of marine water along the ship's hull, if the arrangement is to avoid the use of aprons and the disadvantages connected therewith. When the boundary layer is relatively thick, the pressure differential becomes insufficient for circulation of the cooling water, particularly in types of ships, which have a high planimetric ratio of propulsion, since in the operation of those types, the heavy boundary layer and the zone of flow separation from the ship's hull move approximately uniformly with the ship, without speed differential. Large ships with high planimetric propulsion ratios have boundary layers of several meters thickness, so that cooling water is hard to circulate, except by the undesirable expedient of using aprons or the like.

SUMMARY OF THE INVENTION

It is an object of the invention to avoid the former disadvantages and problems.

It is a more particular object to reduce the influence of the bilge vortices, as well as the influence of the dead water zone, in the field of equal speed lines of the propeller.

Another object is to effect or facilitate circulation of cooling water, particularly for condensors of a ship's propeller power plant, with or without the aid of pumps for such water.

The invention achieves the objects by a method of and apparatus for conducting water through ships, wherein marine water is conducted into the ship in a bilge vortex area, and is discharged from the ship into a dead water area, particularly an upper part of such area above the center of the ship's propeller unit.

When reference is made herein to the use of "marine water" it will be understood that this may be water of the ocean, or water of any other water body where the ship operates.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a vertical longitudinal section through the stern and middle parts of a ship in accordance with the invention;

FIG. 2 is a horizontal section taken generally along line 2—2 in FIG. 1;

FIG. 3 shows, on a larger scale, a condensor, seen along line 3—3 in FIG. 2; and FIG. 4 is one-half of a flow velocity pattern or isotach field, seen in axial direction of the ship and showing the disturbances of such pattern or field encountered in the prior art.

DESCRIPTION OF THE PREFERRED EMBODIMENTS

The ship, defined by outer or hull skin 1 and double bottom 2, has a condensor 3 disposed therein as part of its propulsion plant, for example as part of a turbine 4 for the drive of propeller P. As shown in FIG. 3, this condensor has its inside divided into generally uniform sections by a separator wall 6. The condensor housing is shown as extending across the ship's axis and as having two inlets: inlet 7 on the port side of the ship and inlet 8 on the starboard side of the ship. Outlets 9 and 10 are disposed on top of the condensor housing, each outlet being disposed on the side of the ship opposite the corresponding inlet. Ducts 11 and 12 connect the inlets 7 and 8 with apertures 11*a*, 12*a* in the ship's hull. According to the invention these apertures are disposed substantially in bilge vortex areas, for example in areas of generation of the bilge vortices or in areas of separation of such vortices. These exact areas, characteristic for each type of ship, can be determined if necessary, by tow tests, in ways known to persons skilled in the art. Conduits 13 and 14 connect condensor outlets 9 and 19 with outlet apertures 13*a*, 14*a* in the ship's hull, these outlet apertures being advantageously disposed to discharge into the dead water zone, past the ship's stem 15.

The method of operation according to the invention, and of overcoming former disturbances of the speed lines, can be explained most readily in connection with FIG. 4. In this Figure, disturbance area 16 indicates the effect of a bilge vortex according to the prior art arrangement, while number 17 shows the corresponding extension of a dead water zone in the upper part of the field. The above described system of conducting water through the ship, according to the invention, reduces the disturbed area 16 or avoids the same entirely, while also providing water for filling up the dead water zone 17. As a result, the equal speed line pattern of a ship according to the invention is modified from the former, irregular pattern, shown at 16 and 18 and is materially closer to the regular course of concentric circles 19, around the axis A of the ship's propeller P. By virtue of this new arrangement of equal speed lines, the propulsion of the ship becomes more efficient, and more free of vibrations of the propeller and ship, as will be appreciated by persons skilled in this art.

As shown in FIGS. 2 and 3, the cooling water inlet 11*a* of one condenser chamber (at the right side of separating wall 6) is located on one side of the ship, and this condenser chamber — in a condensor symmetrically extending across the ship's axis A and arranged for a single, longitudinal pass of cooling water — then most conveniently has its outlet 13*a* on the opposite side of the ship. Similarly cooling water inlet 12 on this opposite side conveniently leads through the condenser to a water outlet 14*a* on said one side of the ship.

It will be understood that each of the elements described above, or two or more together, may also find a useful application in other types of methods and apparatus of conducting water through a ship differing from the types described above.

While the invention has been illustrated and described as embodied in a method and apparatus of conducting cooling water through a ship, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims;

1. A method of improving the propulsion characteristics of a powered ship having an only partly submerged hull provided with a partially submerged stern of upwardly divergent cross section and an upper part of which projects rearwardly beyond a lower part thereof, and a propeller located rearwardly of said lower part of said stern, comprising the steps of withdrawing water from the bilge vortex area of the ship's hull in the region where the parallel hull sides begin to taper toward the stern of the hull, so as to reduce turbulence in this region; conducting the withdrawn water through the hull; and discharging the withdrawn water at opposite sides of the lower part of the stern rearwardly and in directions which intersect the axis of rotation of the propeller so that the discharged water enters into a dead water area which is created by rotation of the propeller adjacent to and defined by the stern of the hull and the entrance angle of inflowing water, in order to fill said dead water area with the water withdrawn from the bilge vortex area and improve the propulsion furnished by said propeller and decrease vibrations resulting from its operations.

2. A method as defined in claim 1, wherein the water is conducted through the ship with the aid of suction generated by the propulsion of the ship.

3. A method as defined in claim 1, wherein the water is conducted into the hull in an area of generation of the bilge vortex.

4. A method as defined in claim 1, wherein the water is conducted into the hull in an area of separation of the bilge vortex from the hull.

5. A method as defined in claim 1, wherein the water is discharged from the hull into an upper part of said dead water zone.

6. A method as defined in claim 1, wherein the water is withdrawn from bilge vortex areas on both sides of the hull.

7. A method as defined in claim 1; and further including the step of cooling the ship propulsion plant with said withdrawn water as the same is being conducted through the hull.

8. In a ship, a combination comprising an only partly submerged hull having a mid-portion provided with parallel hull sides and a partially stern portion of upwardly divergent cross-section wherein the hull sides converge from said mid-portion to the stern portion, said stern portion having a lower part and an upper part which projects rearwardly past said lower part; a propeller mounted rearwardly of the lower part of said stern portion of said hull and creating a dead water area when in operation, said dead water area being defined by said stern portion and the entrance angle of the inflowing water; inlet means in said hull for admitting ambient water into the same from the area of the bile vortexes which develop during movement of the hull in the region where said mid-portion and stern-portion join, so as to reduce said bilge vortexes; and outlets at opposite sides of said stern portion for discharging the withdrawn water rearwardly and in directions which intersect the axis of rotation of said propeller, into said dead water area so as to fill the same with said water to improve the propulsion furnished by said propeller and decrease vibrations resulting from its operation.

9. A combination as defined in claim 8, wherein said inlet means comprises a first inlet on the port side of said hull and a second inlet on the starboard side of said hull.

10. A combination as defined in claim 9, further including a power plant for driving said propeller and extending across the longitudinal axis of said hull; said outlets including first and second outlets which communicate with said first and second inlets through said power plant.

11. A combination as defined in claim 8, wherein said outlets are disposed in said hull opposite said propeller.

* * * * *